US008142245B2

(12) United States Patent
Ichikawa et al.

(10) Patent No.: US 8,142,245 B2
(45) Date of Patent: Mar. 27, 2012

(54) OUTBOARD ENGINE UNIT

(75) Inventors: Akiko Ichikawa, Wako (JP); Koji Sakamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 106 days.

(21) Appl. No.: 12/774,348

(22) Filed: May 5, 2010

(65) Prior Publication Data

US 2010/0285705 A1 Nov. 11, 2010

(30) Foreign Application Priority Data

May 7, 2009 (JP) ..... 2009-113063

(51) Int. Cl.
*B63H 20/32* (2006.01)

(52) U.S. Cl. ..... 440/77

(58) Field of Classification Search ..... 123/195 P; 440/77, 88 A

See application file for complete search history.

(56) References Cited

U.S. PATENT DOCUMENTS 5,328,395 A * 7/1994 Oishi ..... 440/77
6,132,273 A * 10/2000 Nakayama et al. ..... 440/77

FOREIGN PATENT DOCUMENTS

JP 09-240588 9/1997

* cited by examiner

*Primary Examiner* — Edwin Swinehart
(74) *Attorney, Agent, or Firm* — Rankin, Hill & Clark LLP

(57) ABSTRACT

An air intake passage system includes an external air intake port provided in a rear portion of a top cover and a passageway section projecting upwardly from the engine cover for directing taken-in external air to the engine. The top cover is provided over the engine cover with a gap therebetween such that the taken-in external air is allowed to flow into the passageway section and a water discharge section is provided between the engine cover and the top cover. Water, having entered together with external air, flows along the upper surface of the engine cover, bypasses the passageway section and is then discharged via the water discharge section.

2 Claims, 7 Drawing Sheets

OUTBOARD ENGINE UNIT

FIELD OF THE INVENTION

The present invention relates to outboard engine units having an external air intake port in an engine cover.

BACKGROUND OF THE INVENTION

Outboard engine units have an external air intake port provided in an engine cover for taking in external air, one example of which is disclosed in Japanese Patent Application Laid-Open Publication No. HEI-09-240588 (JP H09-240588 A).

FIG. 7 hereof is a view explanatory of the outboard engine unit 100 disclosed in JP H09-240588 A, in which an engine is covered with an engine cover 101. External air is introduced or taken in through an external air intake port 103, provided in a top cover 102, as indicated by arrow (1) and then supplied to the engine via an air intake passage 104, provided in the engine cover 102, as indicated by arrow (2). In the outboard engine unit 100, air having water mixed therein may sometimes be taken in, in which case it becomes necessary to supply only the air to the engine with the water removed from the air.

When air having water mixed therein has been taken in through the external air intake port 103, the water hits a vertical blocking plate 105 to be returned to outside of the outboard engine unit 100. Even in case some of the water gets over the vertical blocking plate 105, it falls down onto the air intake passage 104 provided under the external air intake port 103 and is then discharged through a water outlet port. In order to prevent water from entering beyond the vertical blocking plate 105, it is only necessary to increase the height of the vertical blocking plate 105. With the external air intake port 103, air intake passage 104, etc. provided in a vertical arrangement as shown in FIG. 7, it is possible to supply only air to the engine while preventing entry of water into the engine.

However, in the conventionally-known outboard engine unit 100, where the intake port 103, air intake passage 104, etc. are provided in a vertical arrangement, the intake port 103 and the air intake passage 104 have a great combined (or overall) height h, so that the outboard engine unit 100 would have a large dimension in its height direction (i.e., large height). But, some applications require an outboard engine unit having a small height, i.e. an outboard engine unit provided with an engine cover having a small overall height.

SUMMARY OF THE INVENTION

In view of the foregoing prior art problems, it is an object of the present invention to provide an improved outboard engine unit having a reduced height.

In order to accomplish the above-mentioned object, the present invention provides an improved outboard engine unit including an air intake passage system provided in an engine cover for directing external air to an engine, in which the air intake passage system comprises: an external air intake port provided in a rear portion of a top cover; a passageway section projecting upwardly from the engine cover for directing external air, taken in via the external air intake port, to the engine; the top cover provided over the engine cover with a gap therebetween such that the external air from the external air intake port is allowed to flow into the passageway section from above the passageway section; and a water discharge section provided between an upper surface of the engine cover and the top cover. Water, having entered the air intake passage system together with external air via the external air intake port, flows along the upper surface of the engine cover, bypasses the passageway section and is then discharged via the water discharge section.

Because the gap between the engine cover and the top cover is so small to only allow air to enter the interior of the passageway section from above the passageway section, the air intake passage system can have a reduced height. As a result, the outboard engine unit including the air intake passage system can have a reduced height.

Further, even when water has entered via the external air intake port, the present invention allows water to be discharged directly through the water discharge section. Namely, even when a relatively large amount of water entered together with external air, the outboard engine unit of the present invention can separately deal with the air and the water.

Furthermore, because the water discharge section is provided between the top cover and the upper surface of the engine cover, the present invention can achieve an enhanced layout freedom.

In addition, because the engine cover and the top cover may be formed in simple shapes, the present invention can achieve reduced manufacturing cost of the outboard engine unit.

Preferably, the engine cover has an upwardly-convexly-curved central portion. Further, the water discharge section comprises a left water discharge section provided between a front left side portion of the top cover and the upper surface of the upper engine cover, and a right water discharge section provided between a front right side portion of the top cover and the upper surface of the upper engine cover.

Water having entered via the external air intake port is directed leftward and rightward by the upwardly-convexly-curved central portion of the engine cover. Namely, with the upwardly-convexly-curved central portion, the water is directed laterally outwardly toward left and right sides of the engine cover, so that the water can be readily discharged out of the outboard engine unit via the left and right water discharge sections.

Preferably, the engine cover has a downward slanting surface that slants downwardly and forwardly from near the left and right front ends of the upwardly-convexly-curved front central portion. The downward slanting surface allows water to readily flow downward therealong, which can enhance a water discharging efficiency.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

A preferred embodiment of the present invention will hereinafter be described in detail, by way of example only, with reference to the accompanying drawings, in which.

DETAILED DESCRIPTION OF THE PREFERRED EMBODIMENTS

Figure 1:
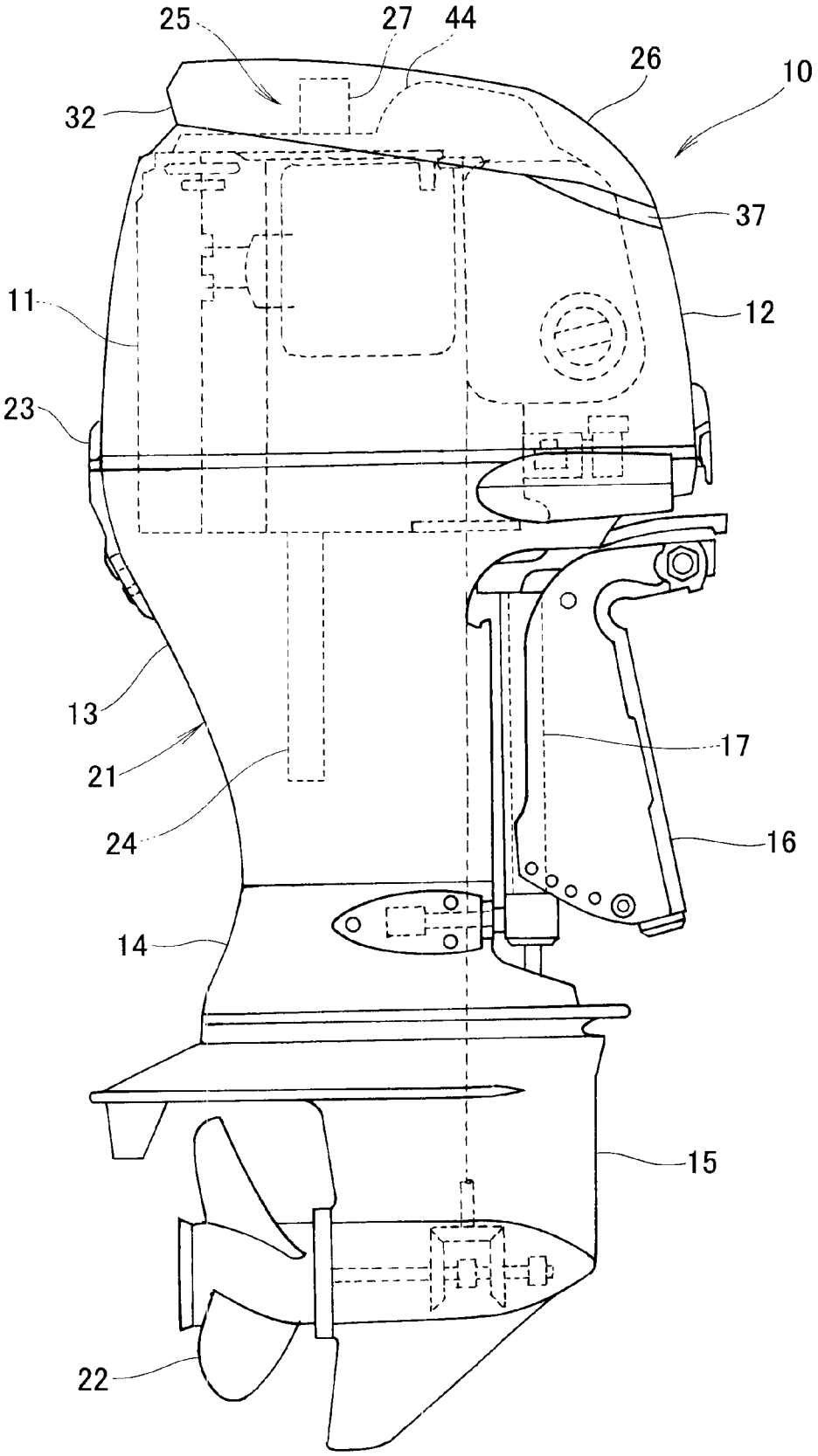
FIG. 1 is a side view showing an overall arrangement of an outboard engine unit according to an embodiment of the present invention.

Reference is now made to FIG. 1 showing in side elevation an overall arrangement of an outboard engine unit according to an embodiment of the present invention. As shown, the outboard engine unit 10 includes an engine 11 provided in an upper section of the unit 10. The engine 11 is a vertically placed engine with a cylinder and piston oriented horizontally and with a crankshaft and cam shaft oriented vertically. A direction in which a boat, having the outboard engine unit 10 mounted thereon, travels forward is a rightward direction in the figure.

The outboard engine unit 10 also includes: an upper engine cover 12 that covers an upper portion of the engine 11; a lower engine cover 13 disposed under the upper engine cover 12 to cover a lower portion of the engine 11; an extension case 14 disposed under the lower engine cover 13; and a gear case 15 disposed under the extension case 14. The upper engine cover 12 and lower engine cover 13 together define an engine cover.

The outboard engine unit 10 includes an outboard engine body 21 mounted via a vertical swivel shaft 17 to a stern bracket 16 that is in turn fixedly connected to a hull or body of the boat, and the engine body 21 is horizontally pivotable relative to the stern bracket 16 up to a predetermined maximum steered angle about the swivel shaft 17.

Behind the gear case 15 is disposed a propeller 22 rotatable by power produced by the engine 11 to provide propelling power. The propeller 22 is switchable between forward rotation and reverse rotation via a pair of dog clutches, to thereby provide forward or rearward propelling power.

The upper engine cover 12 is mounted to the lower engine cover 13 by means of a rear fastener 23 with a hook engaged with a front inner surface of the lower engine cover 13.

The outboard engine unit 10 also has an exhaust passage 24 incorporated therein below the engine 11, for discharging exhaust gas from the engine 11. Further, the outboard engine unit 10 has an air intake passage system 25 provided in the upper engine cover 12 for directing external air to the engine 11, and a top cover 26 provided over the upper engine cover 12.

Figure 2:
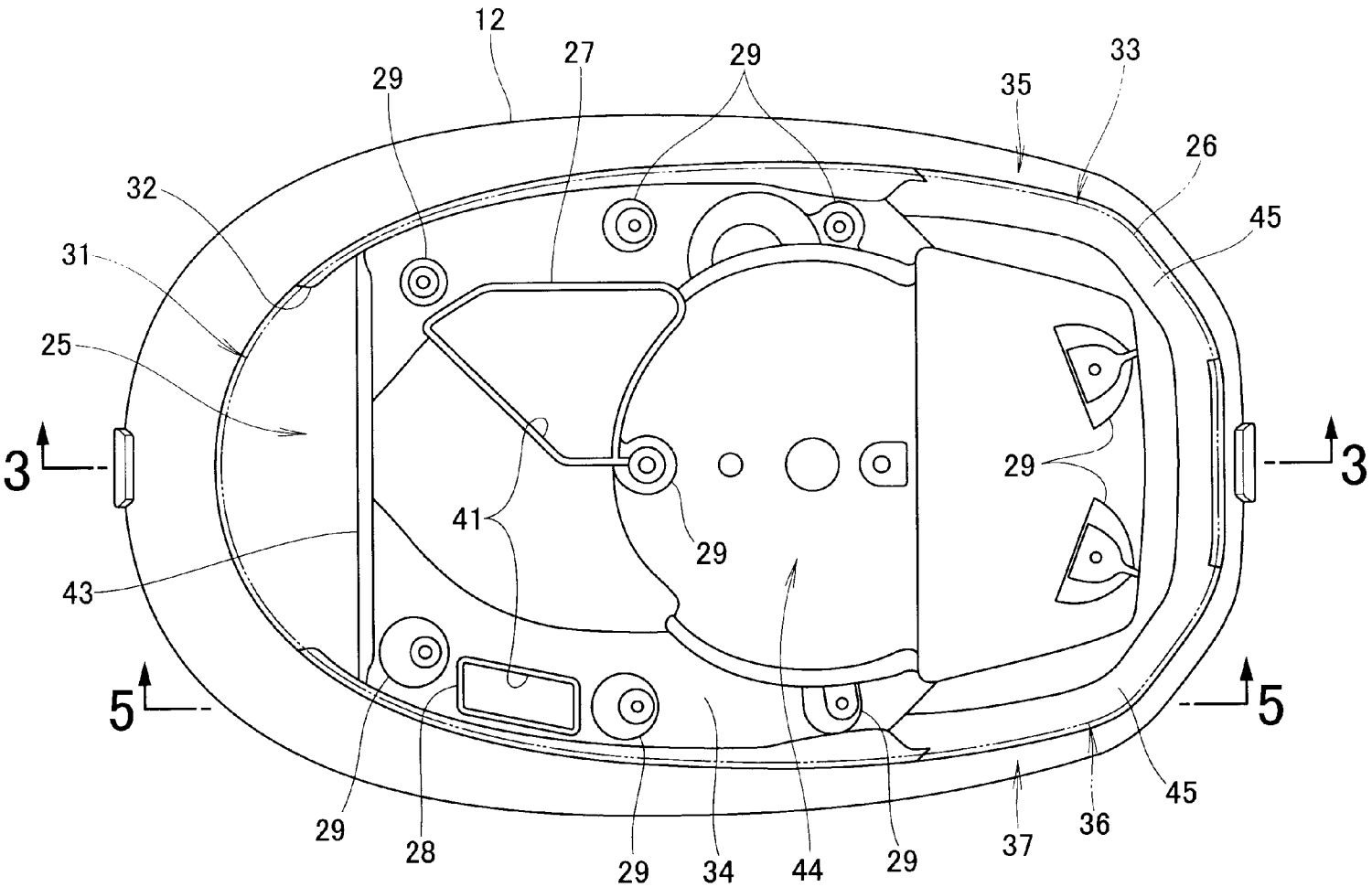
FIG. 2 is a top plan view of an engine cover employed in the outboard engine unit of FIG. 1.

The following describe the air intake passage system 25, with reference to FIG. 2 that is a plan view of the engine cover. As shown, the air intake passage system 25 includes passageway sections 27 and 28 projecting upward (i.e., toward a person viewing the figure) from the upper surface of the upper engine cover 12. The top cover 26 is provided over the upper engine cover 12 by being mounted on mounting sections 29, projecting upwardly from the upper engine cover 12, and thereby covers the upper engine cover 12. An external air intake port 32 is provided in a rear portion 31 of the top cover 26. A left water discharge section 35 is provided between a front left side portion 33 of the top cover 26 and the upper surface 34 of the upper engine cover 12, while a right water discharge section 37 is provided between a front right side portion 36 of the top cover 26 and the upper surface 34 of the upper engine cover 12.

Figure 3:
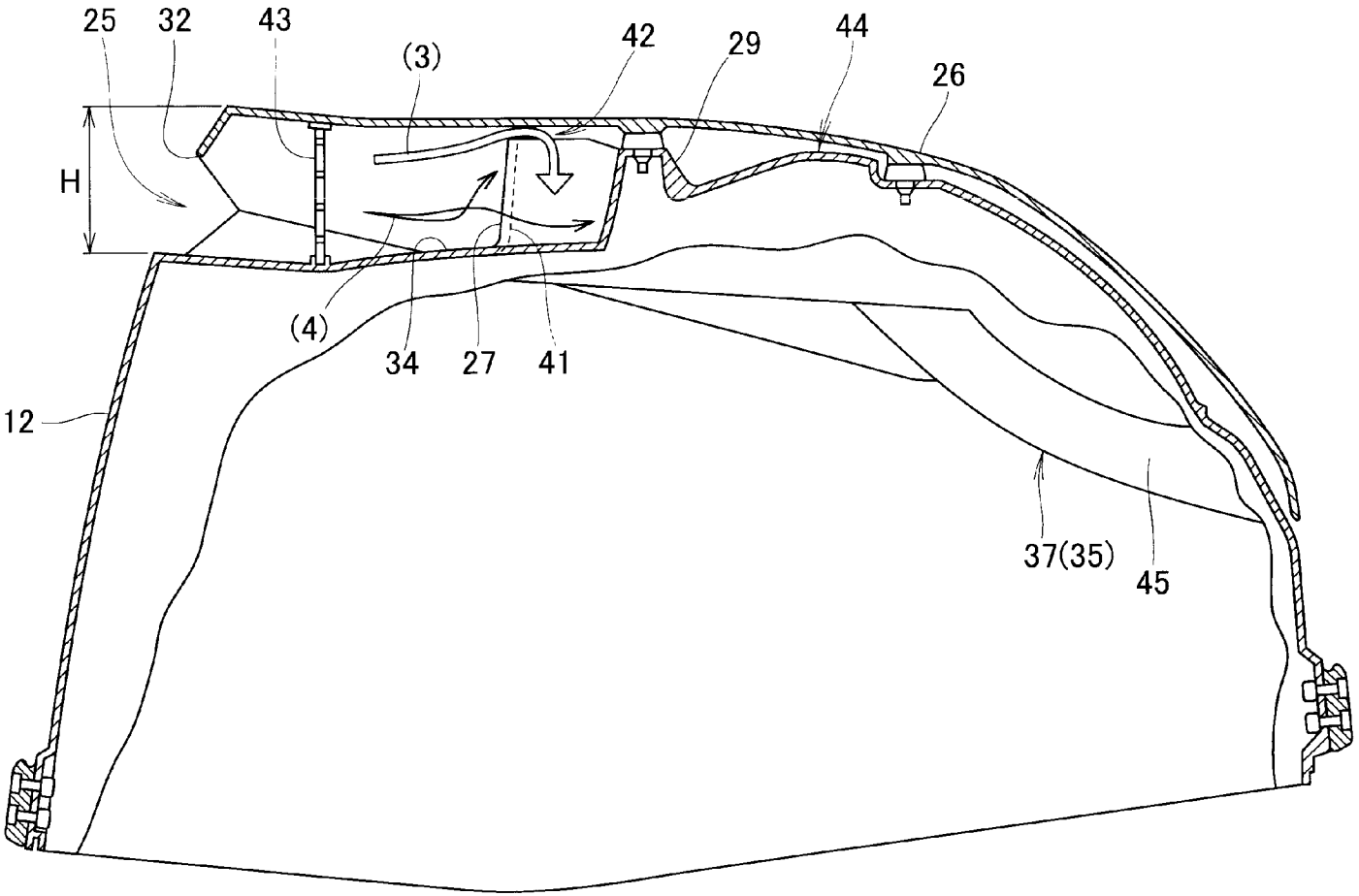
FIG. 3 is a sectional view taken along line 3-3 of FIG. 2.

FIG. 3 is a sectional view taken along the 3-3 line of FIG. 2. The top cover 26 is provided over and covers the upper engine cover 12 with a gap 42 therebetween such that external air is allowed to flow into the interiors 41 of the passageway sections 27 and 28 from above the passageway sections 27 and 28 as indicated by arrow (3).

Water, having entered together with external air via the external air intake port 32 and then through a filter 43, flows along the upper surface 34 of the upper engine cover 12, bypasses the passageway sections 27 and 28 as indicated by arrow (4) and is then discharged via the left and right water discharge sections 35 and 37.

The upper engine cover 12 has an upwardly-convexly-curved front central portion 44, and a downward slanting surface 45 that slants downwardly and forwardly from near left and right front ends of the upwardly-convexly-curved front central portion 44.

Figure 7:
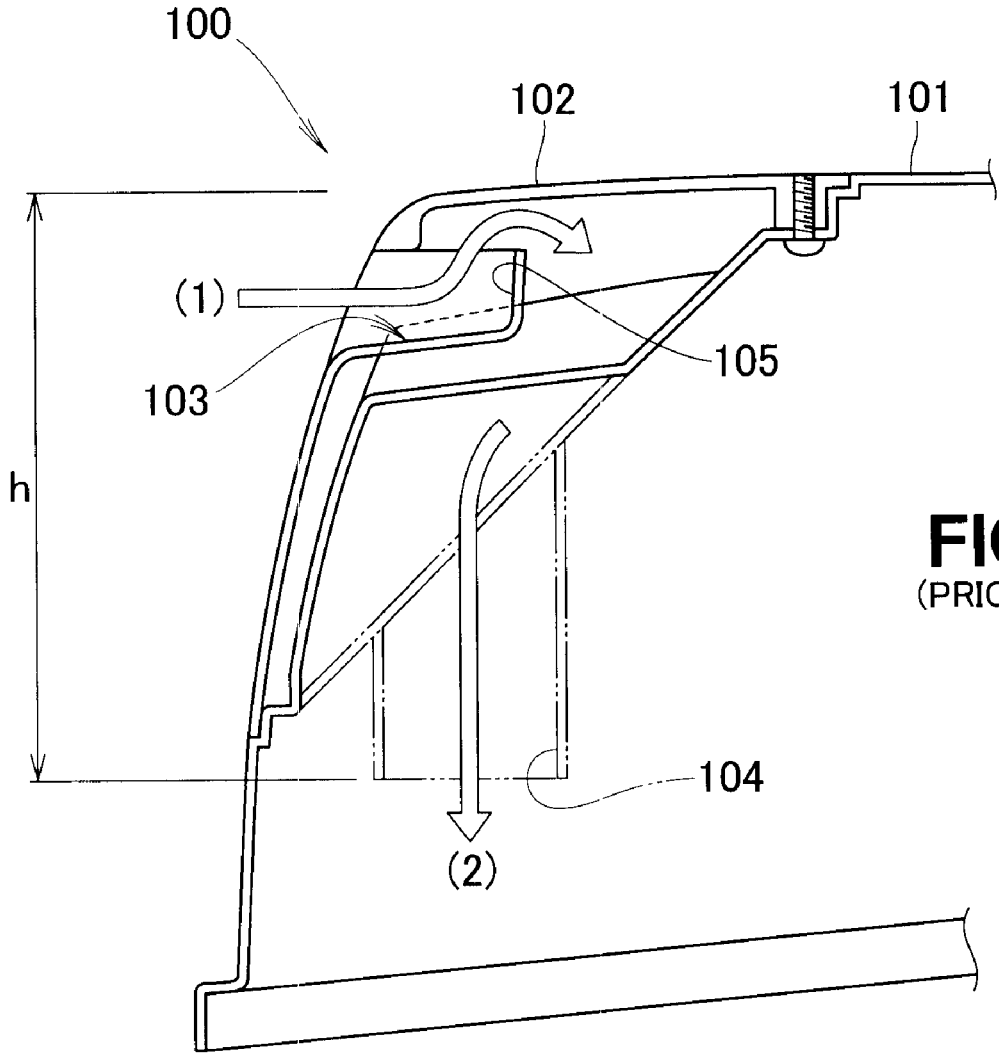
FIG.7 (PRIOR ART)
FIG. 7 is a view illustrating a conventionally-known outboard engine unit.

Because the gap 42 between the engine cover and the top cover 26 is so small to only allow air to enter the interiors 41 of the passageway sections 27 and 28 from above the passageway sections 27 and 28, the air intake passage system 25 can have a reduced height H that is smaller than the combined or overall height h of the vertically-arranged intake port 103 and air intake passage 104 in the conventionally-known outboard engine unit 100 of FIG. 7. As a result, the outboard engine unit 10 can have a reduced height.

Figure 4:
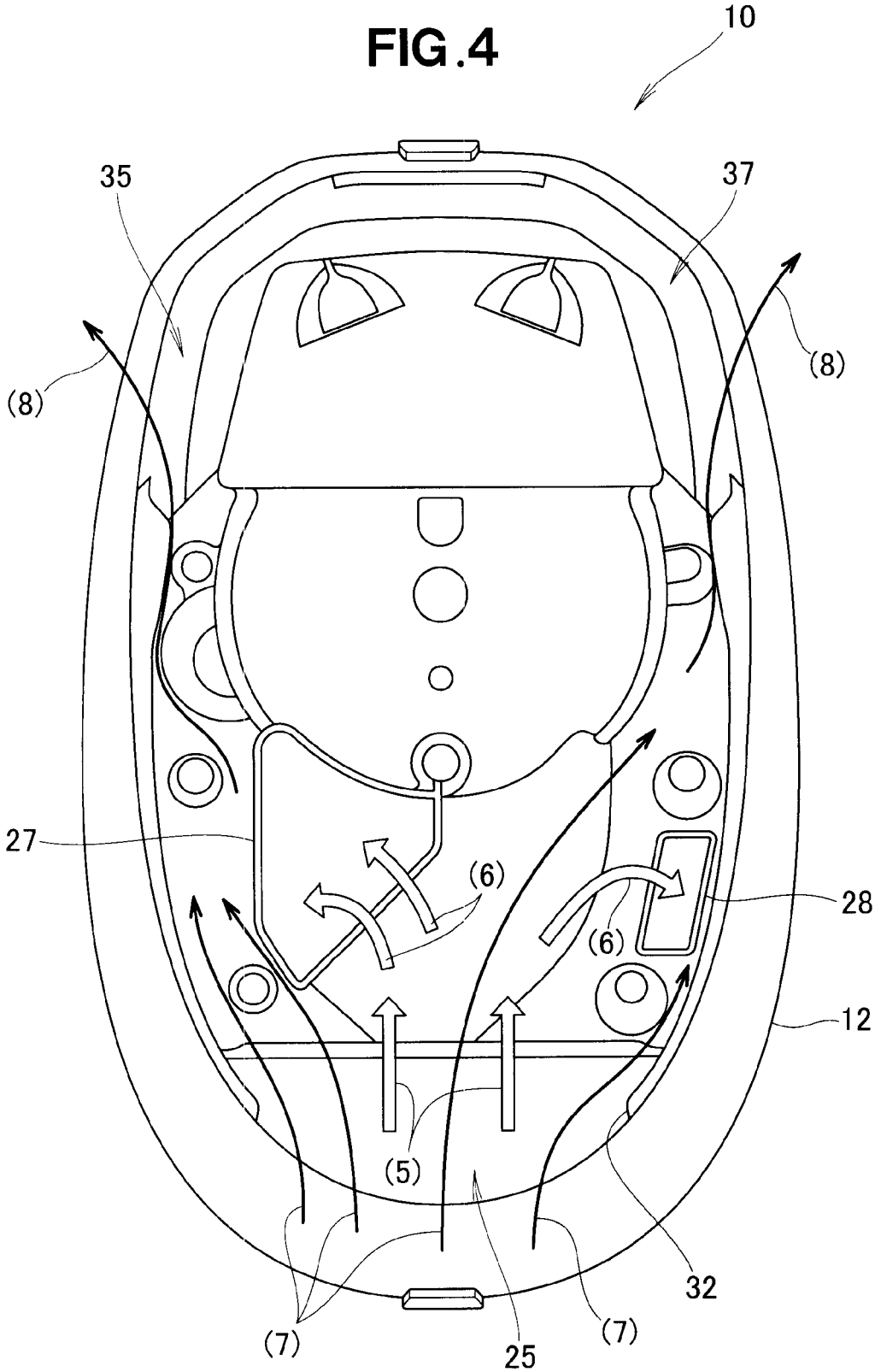
FIG. 4 is a view explanatory of behavior of the embodiment of the outboard engine unit.

Next, a description will be given about behavior of the embodiment of the outboard engine unit 10, with primary reference to FIG. 4 where air flows are indicated by white arrows and water flows are indicated by black arrows. Air, having entered the air intake passage system 25 via the external air intake port 32 as indicated by arrows (5), flows into the passageway sections 27 and 28 as indicated by arrow (6), via which the air is supplied to the engine 11.

Water, having entered the air intake passage system 25 via the external air intake port 32 as indicated by arrows (7), bypasses the passageway sections 27 and 28 to be discharged through the left and right water discharge sections 35 and 37 as indicated by arrows (8). At that time, by the upwardly-convexly-curved central portion 44, the water is directed laterally outwardly toward left and right sides of the engine cover, so that the water can be readily discharged out of the outboard engine unit via the left and right water discharge sections 35 and 37.

Figure 5:
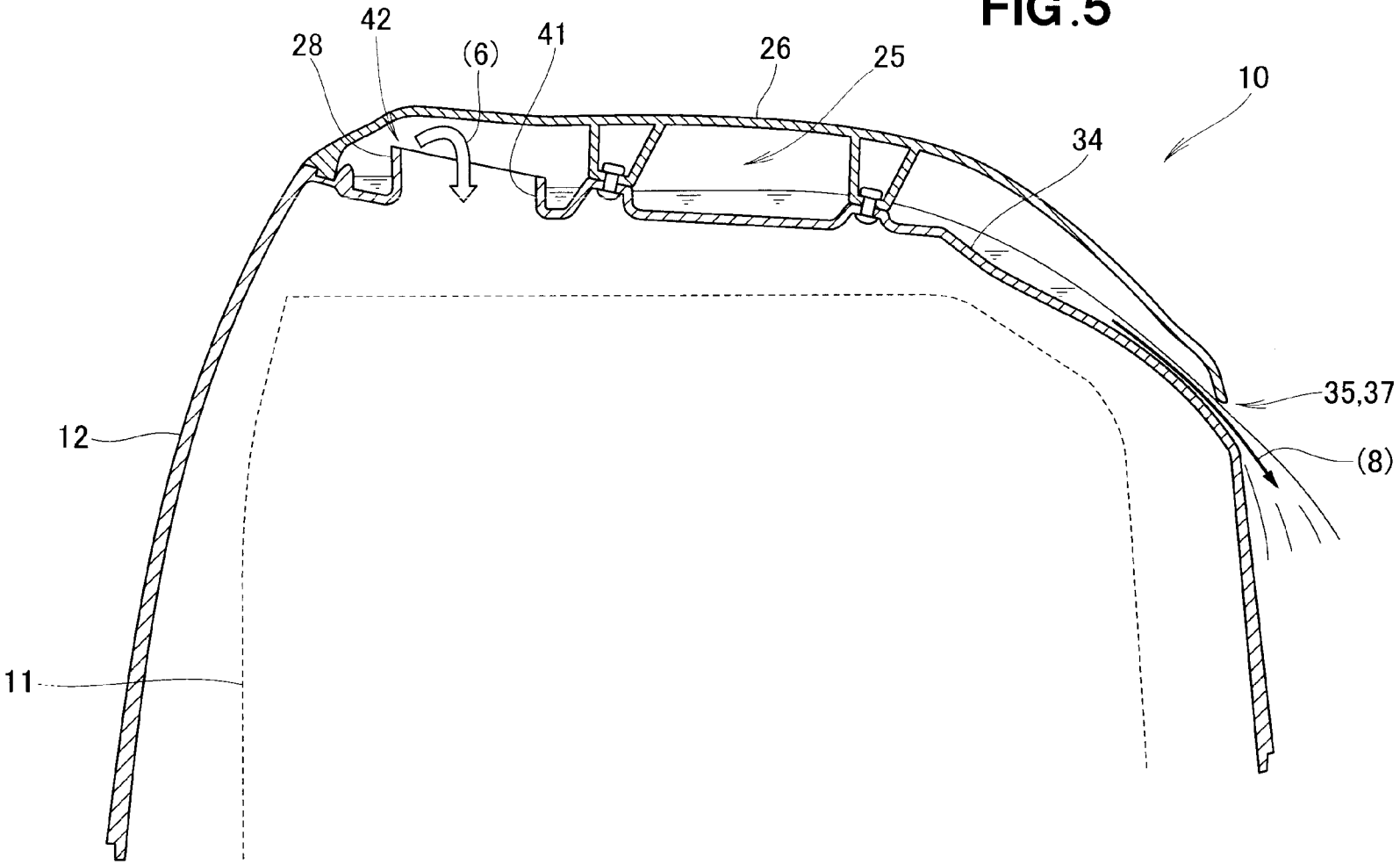
FIG. 5 is a sectional view taken along line 5-5 of FIG. 2.

As also shown in a sectional view of FIG. 5, the air having entered the air intake passage system 25 flows through the interiors 41 of the passageway sections 27 and 28 (only the passageway section 28 is shown in FIG. 5) as indicated by arrows (6) and is then supplied to the engine 11. The water having entered the air intake passage system 25 is discharged via the left and right water discharge sections 35 and 37 as indicated by arrow (8).

Because each of the passageway sections 27 and 28 has a given height such that the water does not enter the interiors 41 of the passageway sections 27 and 28.

Figure 6:
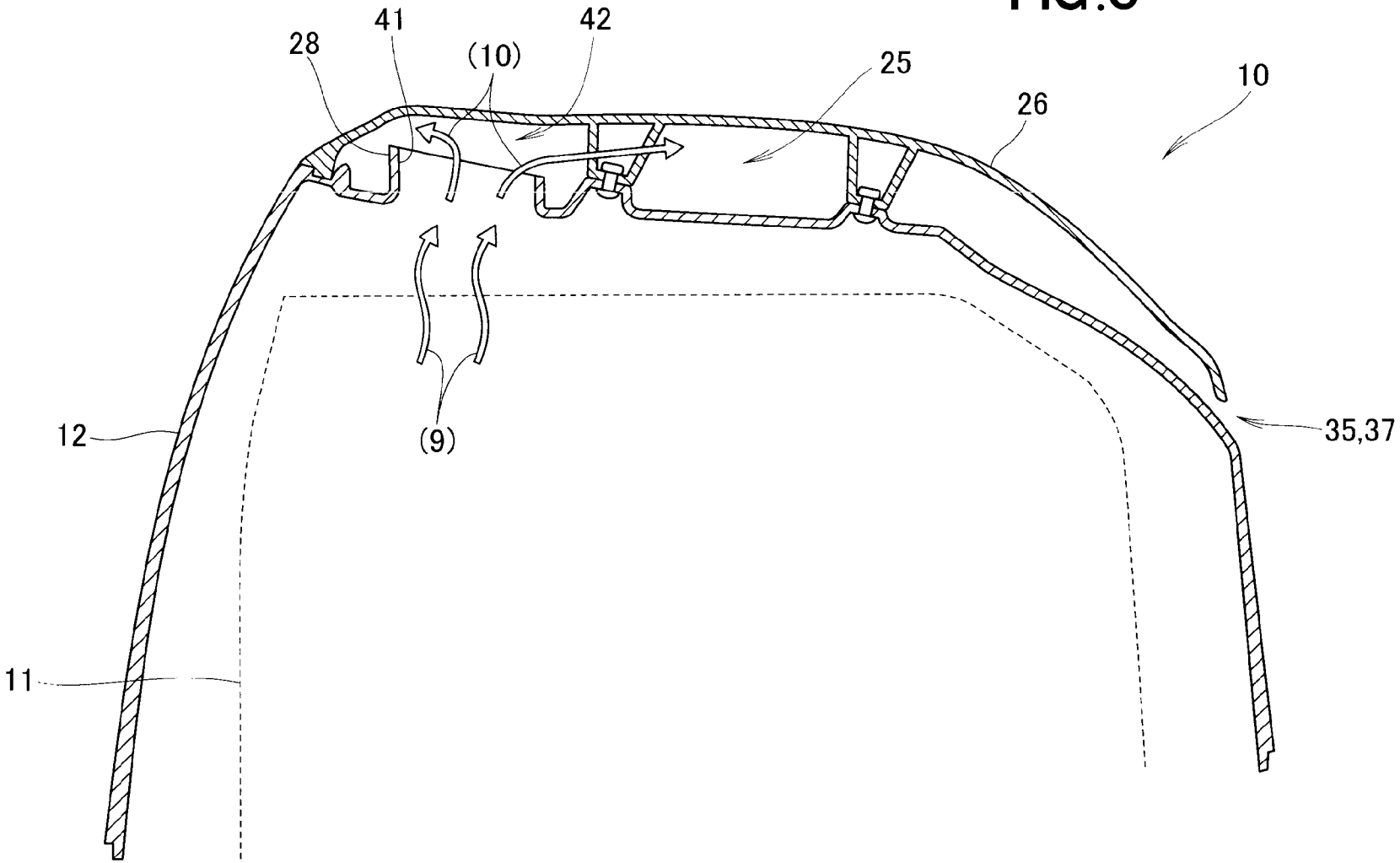
FIG. 6 is a view explanatory of how heat of an engine is discharged in the embodiment of the outboard engine unit.

The following describes how heat of the engine 11 is radiated or discharged in the outboard engine unit 10. As shown in FIG. 6, heat (heated air) of the engine 11 goes upward as indicated by arrows (9) and then passes through the passageway sections 27 and 28 (only the passageway section 28 is shown in FIG. 6) into the air intake passage system 25 as indicated by arrows (10). The heat having entered the air intake passage system 25 in the aforementioned manner is radiated to the outside via the external air intake port 32 and left and right water discharge sections 35 and 37 of FIG. 3. In this way, heat of the engine 11 can be effectively discharged even during stoppage of the engine 11. As a result, the outboard engine unit 10 can minimize an amount of fuel evaporated by heat of the engine 11.

Whereas the embodiment of the outboard engine unit 10 has been described in relation to the case where the left water discharge section 35 is provided in the front left side portion 33 while the right water discharge section 37 is provided in the front right side portion 36, one or more such water discharge sections may be provided in any other suitable positions as long as water can be discharged via the water discharge sections in an appropriate manner.

The present invention is well suited for application to outboard engine units having an external air intake port in an engine cover.

What is claimed is:

1. An outboard engine unit including an air intake passage system provided in an engine cover for directing external air to an engine, the air intake passage system comprising:

an external air intake port provided in a rear portion of a top cover;

a passageway section projectinq upwardly from the engine cover for directing external air, taken in via the external air intake port, to the engine;

the top cover provided over the engine cover with a gap therebetween such that the external air from the external air intake port is allowed to flow into the passageway section from above the passageway section; and a water discharge section provided between an upper surface of the engine cover and the top cover, wherein water, having entered the air intake passage system together with external air via the external air intake port, flows along the upper surface of the engine cover, bypasses the passageway section and is then discharged via the water discharge section, wherein the engine cover has an upwardly-convexly-curved central portion for directing the water, having entered via the external air intake port, laterally outwardly toward left and right sides of the engine cover, and where the water discharge section comprises a left water discharge section provided between a front left side portion of the top cover and the upper surface of the upper engine cover, and a right water discharge section provided between a front right side portion of the top cover and the upper surface of the upper engine cover.

2. The outboard engine unit of claim 1, wherein the engine cover has a downward slanting surface that slants downwardly and forwardly from near left and right front ends of the upwardly-convexly-curved front central portion.

* * * * *